United States Patent [19]

Graef et al.

[11] 4,312,277

[45] Jan. 26, 1982

[54] REMOTE DEPOSITORY WITH SEALED DEPOSIT CONTAINER CONSTRUCTION

[75] Inventors: Harry T. Graef, Dover; Scott A. Mercer, Hanoverton; Jeffrey A. Hill, North Canton, all of Ohio

[73] Assignee: Diebold Incorporated, Canton, Ohio

[21] Appl. No.: 136,528

[22] Filed: Apr. 2, 1980

[51] Int. Cl.[3] ..... G07G 5/00

[52] U.S. Cl. ..... 109/24.1; 109/66; 221/6; 346/22; 232/44

[58] Field of Search ..... 109/24.1, 23, 31, 38, 109/66, 44, 45; 346/22; 221/6; 232/44

[56] References Cited

U.S. PATENT DOCUMENTS

| | | | |
|---|---|---|---|
| 3,836,980 | 9/1974 | Grosswiller | 109/66 |
| 4,067,267 | 1/1978 | McLaughlin | 109/24.1 |
| 4,085,687 | 4/1978 | Beck | 109/24.1 |
| 4,092,934 | 6/1978 | Sayer | 109/24.1 |
| 4,113,140 | 9/1978 | Graef | 221/6 |
| 4,154,437 | 5/1979 | Butcheck | 271/6 |

*Primary Examiner*—Reinaldo P. Machado
*Attorney, Agent, or Firm*—Frease & Bishop

[57] ABSTRACT

A remote depository for receiving bank transaction deposits in envelopes at an unmanned location under conditions of security. The depository has a belt conveyor having entry and exit ends, one of which is closed at all times. The conveyor discharges into a locked deposit receiver such as a container which may be locked when removing it from association with the conveyor. The container may be a sealed, tamper-indicating container latched to the conveyor when unlocked upon being connected with the container. The conveyor has a probe which enters the deposit receiver to sense when the receiver is filled to capacity. If the receiver is completely full, the probe disables the conveyor so that it will not accept additional deposit envelopes.

23 Claims, 18 Drawing Figures

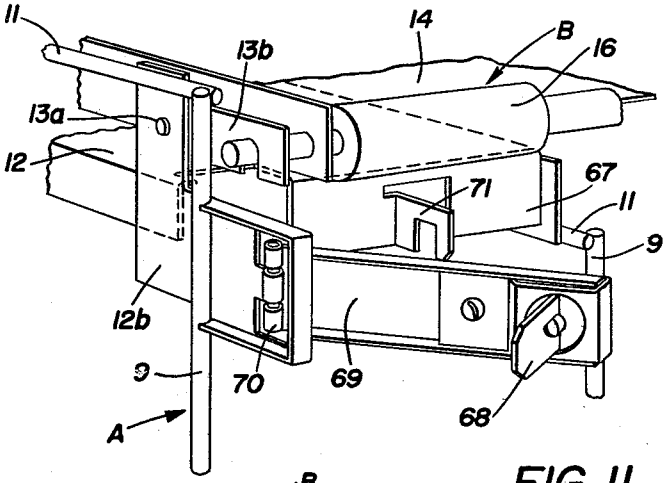
FIG. 11
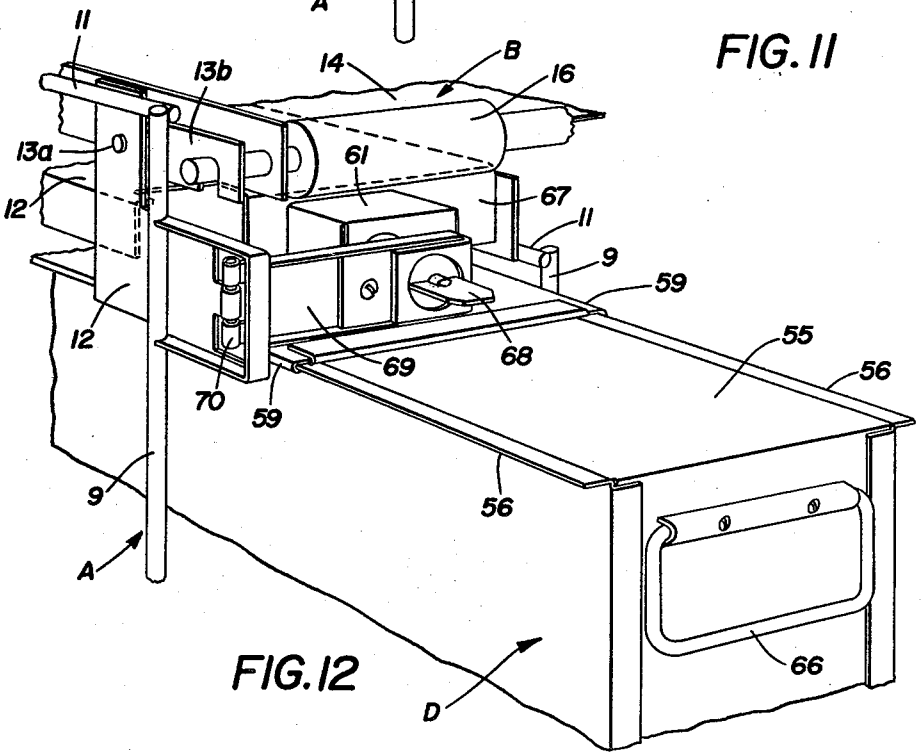
FIG. 12
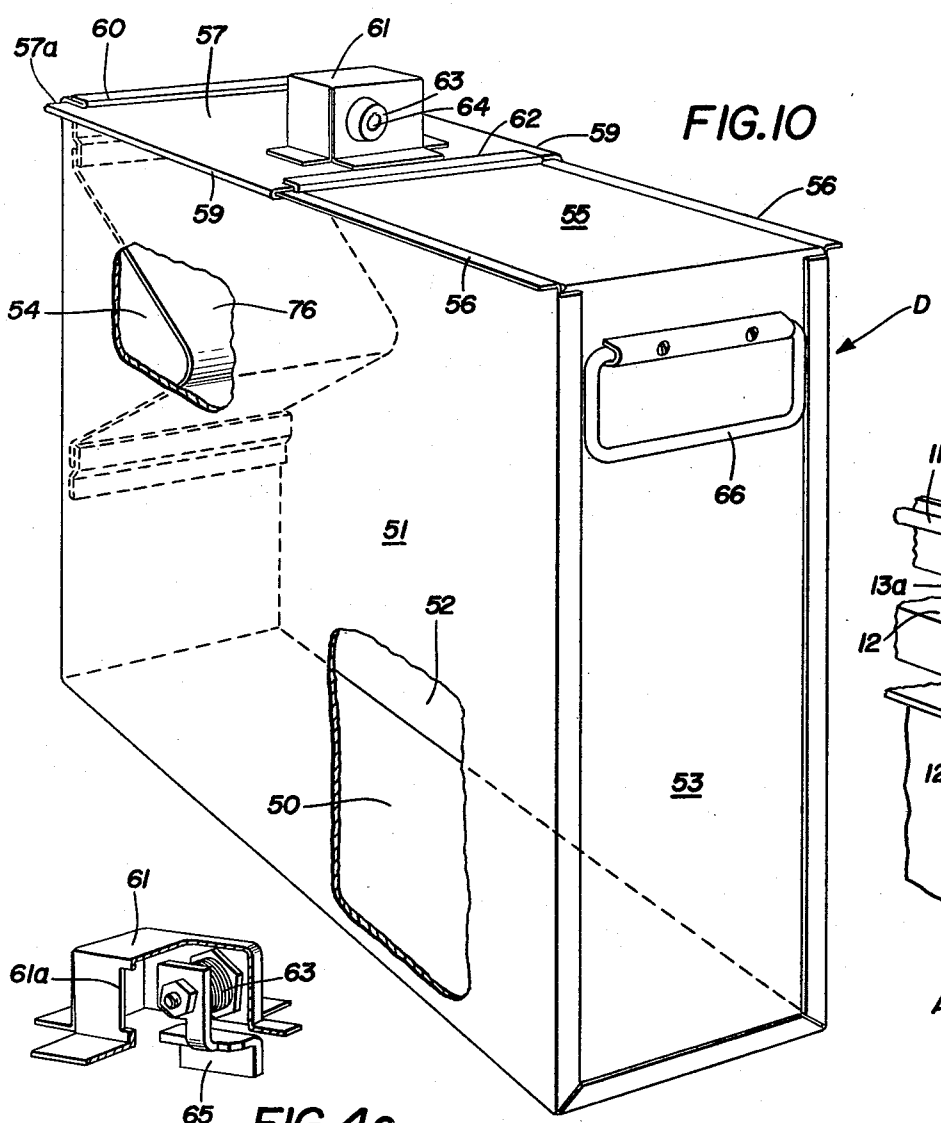
FIG. 10
FIG. 4c

REMOTE DEPOSITORY WITH SEALED DEPOSIT CONTAINER CONSTRUCTION

BACKGROUND OF THE INVENTION

1. Field of the Invention

The invention relates to a depository device for receiving customers' deposits of banking transaction materials under conditions of maximum security. More particularly, the invention relates to depository equipment comprising or forming a part of a remotely installed banking service unit which in the absence of banking personnel will receive and store in a sealed tamper-indicating container deposits of banking materials of various customers in separate envelopes for transport from the remote unit to a central bank where the deposited material in a number of envelopes in the sealed container may be processed to complete the related banking transactions for which the respective envelopes were deposited.

In addition, the invention relates to depository equipment which prevents and thereby controls access to the banking materials in the deposit envelopes by personnel servicing automatic banking machines having depository components.

Finally, the invention relates to depository equipment having the security and deposit handling features described and having a conveyor mechanism for moving a deposit envelope to the sealed container of simplified construction and coordinated control which senses whether the sealed container can accept the deposit of an envelope before it is conveyed to the container.

2. Description of the Prior Art

The prior art abounds with numerous depository devices of all kinds for banking institutions which are designed to receive material to be deposited with the bank in bags or envelopes, particularly at night or at remote unmanned banking units.

Recent developments in remote automatic banking equipment, and particularly remote envelope depository devices are exemplified in the prior art patents discussed below.

The depository device of U.S. Pat. No. 3,836,980 uses a chain conveyor with pushers thereon for moving a deposit-containing envelope from an entry slot in the face of a remote banking unit through a security chamber to discharge the envelope at the exit end of the conveyor into a protective chest in the banking unit. The chest is accessible through a vault or safe door to remove deposit envelopes which accumulate in the chest. The device has a rocker door with conveyor entry and exit barriers one of which is opened when the other is closed and vice versa to prevent access from the banking unit entry slot along the conveyor to the chest at all times.

The depository device of U.S. Pat. No. 4,085,687 avoids difficulties encountered in the use of the construction of the envelope depository of U.S. Pat. No. 3,836,980. It uses a double belt conveyor for moving a deposit-containing envelope from an entry slot in the face of a remote banking unit to discharge the envelope into a vaultlike compartment of the banking unit. The compartment is accessible through a vault or safe door to remove deposit envelopes which accumulate in the compartment. The device has sliding gate plates for the entry and exit ends of the double belt conveyor, one of which is opened when the other is closed and vice versa to prevent access from the banking unit entry slot along the conveyor to the compartment at all times.

Special precautions must be taken and multiple bank personnel must be provided to ensure that the deposit envelopes in the chest or compartment of the depository devices of U.S. Pat. Nos. 3,836,980 and 4,085,687 are delivered to a central bank absolutely free of the occurrence of any undetected access to or removal of or tampering with the deposit envelopes or their contents during unloading of the chest or compartment and during transportation of the envelopes from the remote unit to the central bank where the deposited material in the envelopes is processed.

Thus, an inventory must be taken by multiple bank personnel under protective conditions of all envelopes being moved from the remote banking unit to the central bank as the envelopes are removed from the remote unit chest or compartment. Further, the deposit envelopes must be protected intact in some manner against tampering by the transport personnel during the period of transport from the remote unit to the central bank. Without such inventory and protective measures being taken, loss of envelopes containing deposits or pilfering of or tampering with the contents thereof can occur undetected. Such protective requirements result in substantially increasing the cost of providing remote banking depository services.

U.S. Pat. No. 4,113,140 discloses protective sealed tamper-indicating money dispensing containers and procedures used in supplying automatic banking equipment cash dispensing services. Paper money bills in the sealed containers may be delivered from a central bank and installed in a remote cash dispenser unit under high security conditions with a minimum expense of providing such remote cash dispensing services. Such system and equipment, however, does not provide any means for protecting deposited material at the remote unit which must be transported back to the central bank.

U.S. Pat. No. 4,154,437 discloses remote cash dispensing equipment utilizing the sealed tamper-indicating money dispensing containers of U.S. Pat. No. 4,113,140 at a remote banking unit which also accepts and stores deposited envelopes. However, although the depository conveyor equipment in U.S. Pat. No. 4,154,437 is very simplified, as compared with the conveyor equipment in each of U.S. Pat. Nos. 3,836,980 and 4,085,687, nevertheless, the expense of providing the remote depository service is still much higher than desired since the deposit envelopes are discharged, just as in the earlier depository device U.S. Pat. Nos. 3,836,980 and 4,085,687, merely into a protective chest in the remote unit. Thus, the same special precautions and multiple personnel inventory requirements exist to protect the integrity of envelopes deposited in the equipment of U.S. Pat. No. 4,154,437 when removing the envelopes and transporting the envelopes to the central bank for processing.

There are no provisions in the prior art, of which we are aware, for maximum security in the handling and delivering of banking materials deposited in envelopes at a remote unattended automatic banking depository unit that avoid the necessity of taking the special precautions and using the multiple personnel inventory procedures described which heretofore have been required to be taken and used with prior art devices to protect the integrity of envelopes deposited in a remote depository when removing the envelopes from the remote unit and transferring the envelopes to a central bank for processing.

There thus exists a need in the field of supplying remote unattended depository banking services and equipment which will accept deposit envelopes and enable their removal from the remote banking unit and delivery to a central bank under sealed tamper-indicating conditions and at minimum cost, by accountable messengers who have no direct access to the deposit-containing envelopes, per se.

Further, the need exists for such equipment that provides maximum security and low cost remote depository banking services which is very simple in construction, which requires little, if any, maintenance, which is very reliable and effective in operation, which is capable of handling envelopes of various sizes containing deposit material which may vary in thickness from envelope to envelope, and which consists of very few simple components.

SUMMARY OF THE INVENTION

Objectives of the invention include providing a depository device for use in a remote unattended banking system unit having a simple conveyor component which receives a deposit envelope at an entry slot in the face plate of the unit and conveys such envelope from the entry slot to and drops it into an opening in a container component which is locked to the unit; providing such depository device in which through-access along the conveyor from the entry slot to the container opening is blocked at all times either ahead of or behind the envelope as the envelope is conveyed from the entry slot to the container opening; providing such depository device in which the conveyor component probes the container component to determine, before accepting deposit of any envelope, whether the container has room to receive or accept placement of such envelope therein; providing such depository device in which the container component is sealed in tamper-indicating condition with its opening, through which deposit envelopes are placed in the container, closed and locked before the container component can be removed from the remote banking unit; and providing such depository device which achieves the stated objectives in a most efficient and highly secure manner, which eliminates the high cost heretofore required of providing remote depository banking services, and which satisfies needs existing in the field of automatic remote depository banking services.

Such objectives are obtained by the depository equipment generally stated as including a housing having a deposit envelope entry slot; belt conveyor means having entry and exit ends; the conveyor means entry end being located adjacent to but spaced from said entry slot; said conveyor means including a flat plate platen, a pressure plate, endless belt means looped around a pair of spaced belt conveyor rolls, and one flight of the belt means extending between and being movable along the platen from one conveyor roll to the other between said platen and pressure plates; said conveyor rolls being located respectively at the conveyor means entry and exit ends, and drive means for at least one of said conveyor rolls; a discharge opening formed in the platen adjacent the belt means; a barrier member pivotally mounted intermediate its ends on the conveyor means having an entry barrier plate and gate barrier plates, respectively, at its ends; said barrier member being movable between normally closed and open positions, the entry barrier plate being located in the space between the conveyor means entry end and said entry slot when the barrier member is in closed position, and said gate barrier plates being located above the platen and above said platen discharge opening when the barrier member is in normally closed position; a container having a deposit-receiving-opening, a lid for the deposit-receiving-opening movable relative to the container between open and closed positions and lock means for locking the lid in closed position; and said container with the lid in open position being located with its deposit-receiving-opening immediately beneath said platen discharge opening.

BRIEF DESCRIPTION OF THE DRAWINGS

A preferred embodiment of the invention—illustrative of the best mode in which applicants have contemplated applying the principles—is set forth in the following description and shown in the drawings and is particularly and distinctly pointed out and set forth in the appended claims.

FIG. 4*c* is a fragmentary, perspective partially sectional view showing the container lock bolt;

FIG. 10 is a perspective view of a sealed tamper-indicating depository container component used to transport envelopes from a remote unit to a central bank in accordance with the invention;

FIG. 11 is a fragmentary perspective view of the device with a sealed container removed ready to receive an empty container, and showing the captive key at the remote unit for controlling installation and use of an empty container;

FIG. 12 is a view similar to FIG. 11 showing an empty container of FIG. 10 partially installed and the captive key in position to unlock the container lock and to latch the container to the unit;

Similar numerals refer to similar parts throughout the various figures of the drawings.

DESCRIPTION OF THE PREFERRED EMBODIMENT

Figure 1:
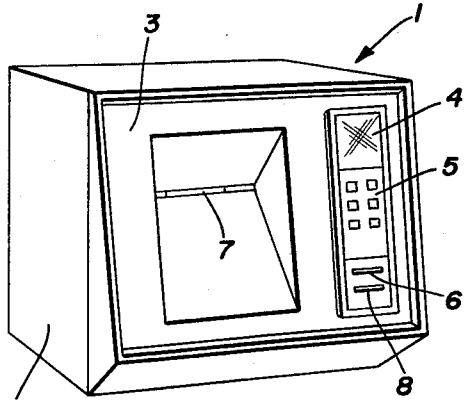
FIG. 1 is a diagrammatic perspective view of an automatic banking remote depository unit equipped with the improved depository device.
Figure 3:
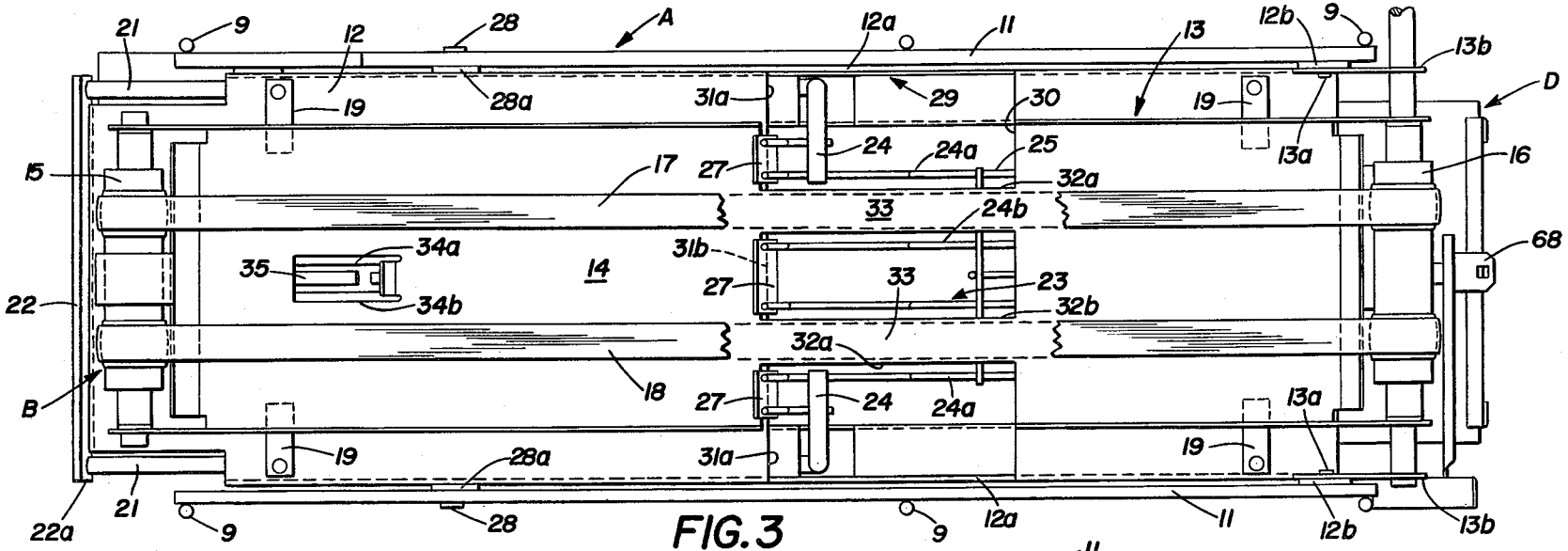
FIG. 3 is a top plan view of the device shown in FIG. 2.

A remote unmanned automatic banking unit equipped with the improved depository device for accepting envelope deposits is indicated generally at 1 in FIG. 1. The unit 1 may comprise merely a depository device having a housing 2 and a face plate 3 containing an instruction panel 4 for displaying instructions for use of the depository unit. A keyboard 5 mounted on plate 3 may be used to actuate operation of the depository device 1, which also may have a card entry slot 6 for insertion of a personalized conventional magnetic-stripe plastic coded card for initiating a transaction and for identifying the customer making a deposit of an envelope at the remote unmanned depository.

The face plate 6 also may be provided with an envelope entry slot 7 through which deposit envelopes containing deposit material are entered into the unit 1. Finally, the face plate 3 may be equipped in a usual manner with a receipt slot 8 where a receipt for a transaction may be delivered to the customer at the completion of the depositing operation.

Although the invention is illustrated and described with respect to a depository unit 1 for accepting banking transaction deposits at a remote umanned location, the improved depository device may form part of a typical automatic cash dispenser such as disclosed in U.S. Pat. No. 4,154,437.

Figure 2:
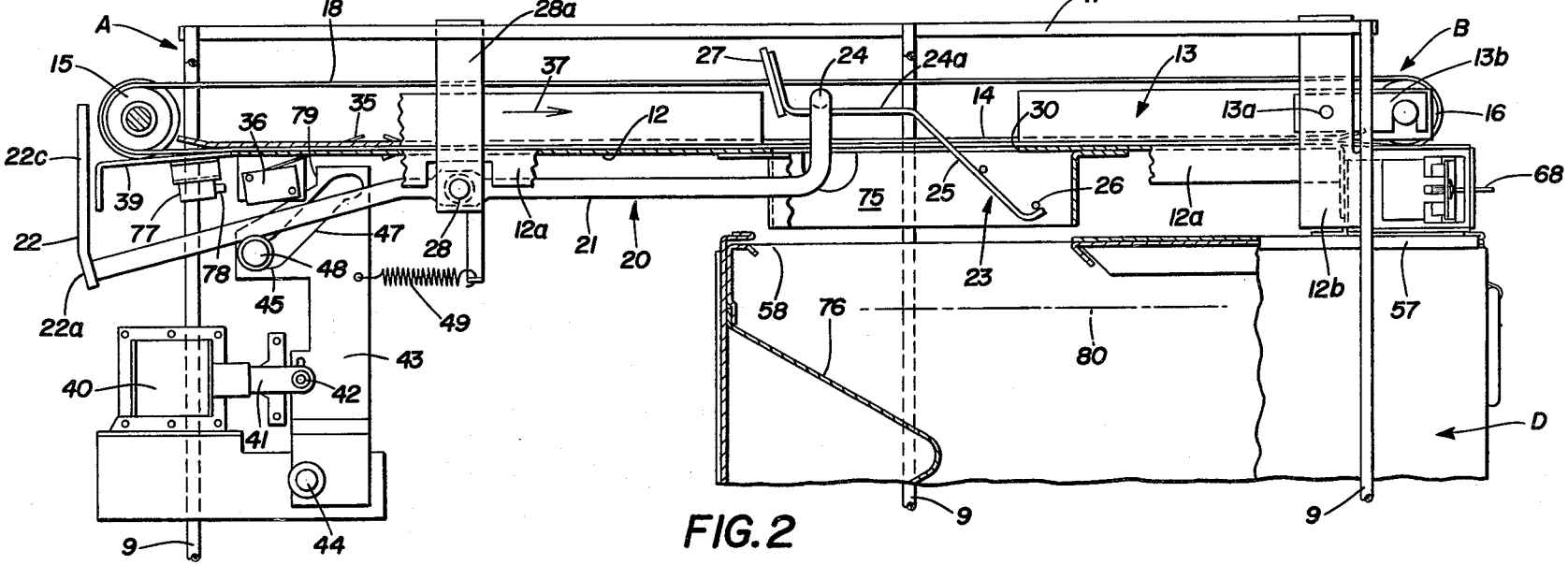
FIG. 2 is an enlarged fragmentary side elevation, with parts broken away of the new device showing the conveyor and container components in normal assembled and operative condition.

Components of the depository unit 1 within the housing 2 are mounted on a frame A formed of members 9 extending upward from a base member 10 and joined by top stringer members 11. Conveyor mechanism B is mounted within the frame structure A and includes a plate-like platen 12 with an overlying conveyor belt assembly generally indicated at 13. Platen 12 may be mounted on frame A by side flanges **12*a* welded to support bars 28*a* and end plates 12*b*. Belt assembly 13 is pivotally coupled at 13*a* to end plates 12*b* by links 13*b* engaging belt roll 16** (FIG. 2).

The conveyor belt assembly 13 includes a rigid flat metal pressure or backup plate 14 at the ends of which belt rolls 15 and 16 are journaled. A pair of endless rubber belts 17 and 18, spaced apart laterally, are trained around the belt rolls 15 and 16 and the belts may be driven in the desired direction by any suitable drive means, not shown, connected with one of the belt rolls 15 or 16 by a drive pulley as described in U.S. Pat. No. 4,154,437.

The conveyor belt assembly 13 is supported upon the conveyor platen 12 with the lower run of the belts movable between the platen 12 and backup plate 14. The belt assembly 13 preferably floats upon the platen in order to accommodate envelopes with deposit material therein of various thicknesses which may be conveyed by the conveyor.

Figure 4:
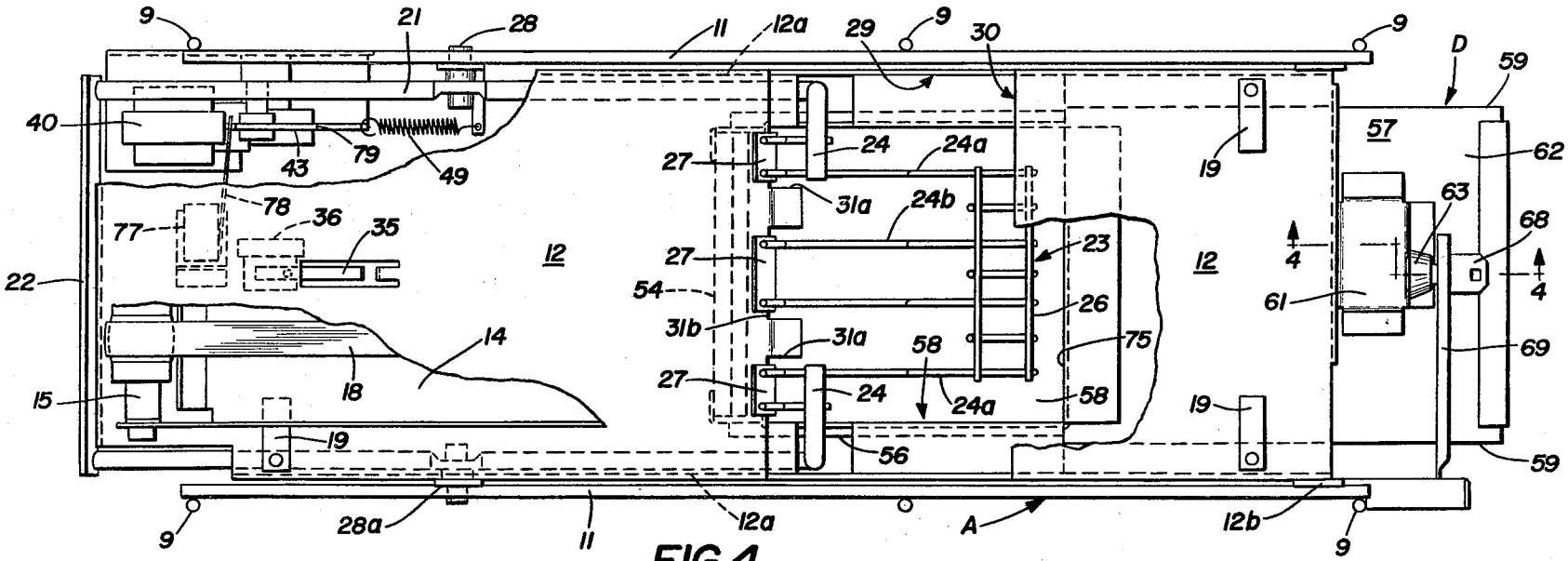
FIG. 4 is a fragmentary top view of the conveyor platen with the belts and backup plate assembly broken away.

Preferably the backup plate 14 may be supported at its edges on the platen 12 by slightly springy shims 19 (FIG. 4) if desired. However, the shims may not be necessary since the weight of the conveyor belt assembly 13 and its backup pressure plate 14 are intended to function to press the belts 17 and 18 against and frictionally engage the envelopes to convey the envelopes along the platen. In general, the belt conveyor mechanism illustrated and described, including a platen 12 and its conveyor belt assembly 13, may have a construction similar to that shown and described in the Harry T. Graef patent application for Paper Currency Transport Construction, filed Nov. 15, 1979, Ser. No. 94,151.

A barrier member generally indicated at 20 has a frame-like shape, formed by spaced lever members 21 having an entry barrier plate 22 mounted on one pair of ends of the lever members 21 and an open lattice-frame probe member 23 carried by ears 24 extending upward, inward from the other ends of the lever members 21. Barrier member 20 is generally rectangularly shaped and, in effect, surrounds the entry end and side portions of the conveyor B. The lattice-frame probe 23 has end finger portions **24*a* extending rearwardly from the ears 24 terminating in downwardly angled portions 25 which are joined by a cross probe sensor member 26. A middle finger portion 24*b* is mounted on the cross probe member 26 and is located laterally between and spaced from the end fingers 24*a*. The fingers 24*a* and 24*b* each are provided with rear gate barrier plate 27 normally located above the platen 12** in a manner described below.

The barrier frame levers 21 are pivotally mounted intermediate their ends at 28 on support bars **28*a* mounted on the top stringers 11** of the frame structure A.

Figure 5:
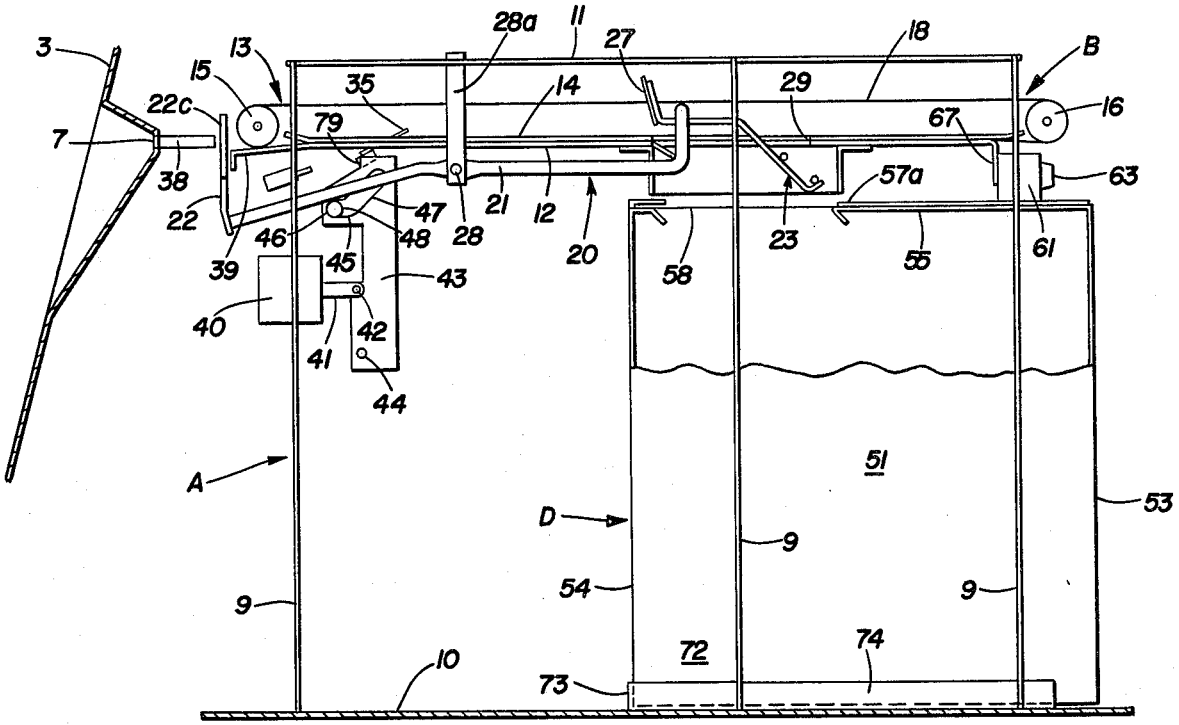
FIG. 5 is a diagrammatic view illustrating the conveyor component in normal closed position.
Figure 6:
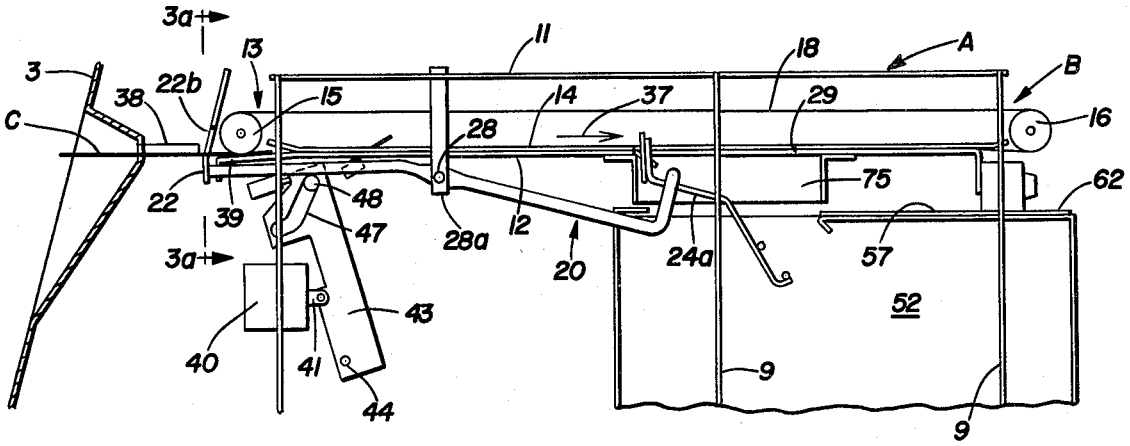
FIG. 6 is a view similar to FIG. 5 showing the pivoted conveyor barrier member actuated to open position to accept insertion of a deposit envelope.

In order to accommodate movement of rear gate barrier plates 27 and probe finger portions **24*a* and 24*b* from a location above the conveyor platen 12, as shown in FIG. 5, to a location below the platen, as shown in FIG. 6, the platen 12 is formed with an opening 29 extending to a zone 30 above the cross probe sensor member 26, and the opening 29 is notched at 31*a* and 31*b* in the region below the fingers 24*a* and 24*b* and rear gate barrier plates 27**.

Similarly the conveyor belt backup plate 14 is formed with openings **32*a* and 32*b* registering with notches 31*a* and 31*b* to permit movement of the prong fingers therethrough. Backup plate strip portions 33 separate the openings 32*a* and 32*b* to provide backup support for the belts 17 and 18 which move across the opening 29 in the platen 12**.

The conveyor plate 12 and backup plate 14 are provided with matching longitudinal slots **34*a* and 34*b* close to the location of the barrier pivot 28 between the two belts 17 and 18 to permit an actuator finger 35 of a microswitch 36 to project through the path of travel of an envelope conveyed in the direction of the arrow 37** along the conveyor for a purpose to be described.

Figure 3A:
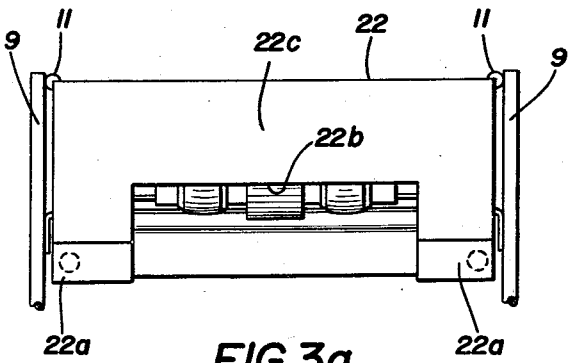
FIG. 3*a* is a fragmentary view looking in the direction of arrow 3*a*—3*a*—FIG. 6 showing the entry notch in the entry barrier.

The entry barrier plate 22 (FIG. 3*a*) is mounted at lower corner portions **22*a* on the ends of the barrier lever members 21, and the plate 22 extends upward therefrom. The lower portion of the plate 22 between corner portions 22*a* is formed with an elongated notch 22*b* below the barrier portion 22*c***.

The remote depository unit mechanism 1 is located within the housing 2 in a position so that the envelope entry slot 7 (FIG. 5) is aligned generally with the bite of the conveyor mechanism B. Preferably a tubular entry channel 38 extends from the entry slot 7 within the housing 2 to a zone adjacent and close to the entry end 39 of the conveyor platen 12. Normally, as shown in FIG. 5, the barrier portion 22c of the entry barrier plate 22 is located between and fills the space between the inner end of the tubular entry channel 38 and the entry end 39 of the conveyor B to block communication therebetween. This prevents "fishing" of the interior of the depository unit 1 from the outside through the entry slot 7. This is the normal closed position of the depository unit 1.

The unit 1 is provided with a solenoid 40 mounted on the frame A having an armature 41 pivotally connected at 42 with a depository actuator cam 43 pivotally mounted at 44 and having a cam slot 45 therein. The cam slot 45 has a horizontal lock section 46 and an angular actuating section 47. A roller cam follower 48 carried by the barrier lever member 21 intermediate the pivotal mounting 28 for the lever and the entry barrier plate 22, is engaged in and is movable along cam slot 45.

When the depository is in the normal closed position, shown in FIG. 5, the cam roller follower 48 is located in the horizontal cam section 46. The actuator 43 is held biased in this normal position by a spring 49. When the cam follower roller 48 is held in the horizontal section 46 movement of the barrier member 20 away from the normal closed position is prevented, even if it is attempted to apply force to the entry barrier plate 22 from the exterior of the housing 2.

Activating the depository for accepting a deposit involves energizing the solenoid 40 to retract the armature 41 and move the actuator 43 on its pivot 44 so that the cam follower roller 48 rides up the angular cam section 47 and rotates the barrier member 20 about its pivot 28 raising the entry barrier plate 22 to a position such as shown in FIG. 6 at which time the barrier notch 22b is aligned with the entry channel 38 and the entry end 39 of the conveyor B so that a deposit envelope C can be fed into the depository unit 1.

One facet of the new remote depository concept of the invention relates to a sealed tamper-indicating deposit-envelope-receiving container component which is combined and coordinated in an interrelated manner with the conveyor mechanism B and its barrier member 20. The sealed container, generally indicated at D, is shown in FIG. 10. The container D has a bottom wall 50, side walls 51 and 52, and end walls 53 and 54. The container permanent top wall 55 encloses approximately one-half of the upper end of the container and there are outturned edge flanges 56 at the top of side walls 51 and 52 slidably receiving a movable lid 57 which is adapted to close the opening 58 in the upper end portion of the container left open by the top wall 55.

The lid 57 has channel flanges 59 slidably mounted on the container flanges 56. When the lid 57 is closed its front edge 57a is engaged under and covered by an inturned flange 60 at the upper end of the container end wall 54. A lock housing 61 is mounted on the lid 57 adjacent the rear edge 62 of the lid, containing a lock 63 having a keyhole 64. The lock 63 has a pivoted bolt 65 which, when in locked position, engages the inner edge of the top wall portion 55 which in part forms the opening 58. The container D may have one or more handles 66 for ease in lifting and moving the container.

Figure 13:
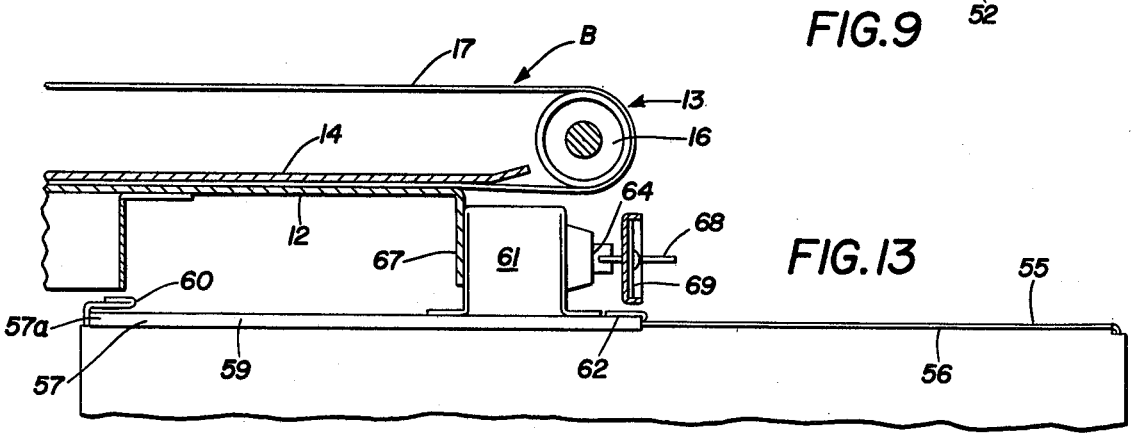
FIG. 13 is a fragmentary side view showing the partially installed container with its lid unlocked and the container latched to the unit.

The container D normally is empty and in locked condition when delivered to a remote depository unit 1. It is inserted so locked within the mechanism frame A beneath the belt roll 16 at the discharge end of the conveyor mechanism B, as shown in FIG. 13. There is a space or cavity (FIG. 11) beneath the conveyor into which the container D is moved to the position shown in FIGS. 12 and 13. During insertion and coupling of the container D into and with the depository unit conveyor mechanism B, the lock housing 61 on the lid 57 (held locked in the position shown) telescopes over a notched flange 71 projection from (FIG. 11) a stop member 67 carried by the frame A. The lock housing then engages stop member 67 preventing further movement of the container D into the frame A beneath the conveyor B.

At this time, a captive key 68 carried on a bracket 69 hinged at 70 to the frame A beneath the conveyor belt roll 16 is moved to the position shown in FIG. 12 where the key can be inserted into the keyhole 64 of lock 63 and turned to release the bolt 65 from engagement with the container top wall 55 (thus unlocking the lid 57). At the same time, the bolt 65 engages the notched flange 71 and locks the lid 57 to the stop member 67 as shown in FIGS. 12 and 13.

In this manner, the lid 57 is unlocked from the container but is locked in a position coupled with the frame A. At this time, the container D may be moved with reference to the lid 57 further beneath the conveyor B to a final container "open" position as shown in FIGS. 5, 6 and 14, where the container opening 58 is located beneath the probe 23 so that envelopes delivered by the conveyor B are directed by the probe 23 into the container D as shown in FIG. 8.

Figure 14:
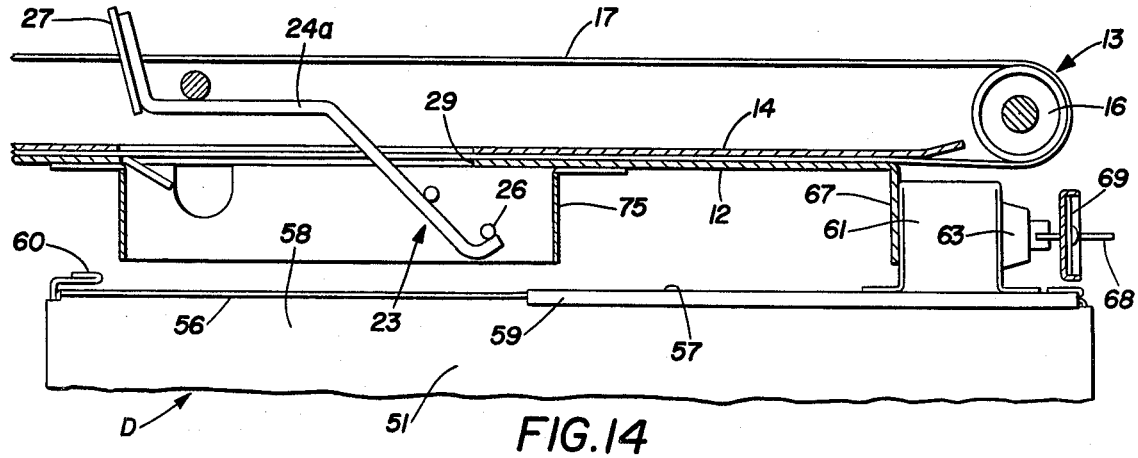
FIG. 14 is a view similar to FIG. 13 showing the container lid held latched to the unit and the container body moved to a position to accept envelopes discharged from the conveyor.

As the container D is moved from the closed position shown in FIG. 13 to the open position, indicated for example in FIGS. 5 and 14, movement may be stopped when the lower end 72 of the container engages a stop flange 73 on guide means 74 mounted on the base member 10 (FIG. 5). This locates the top opening 58 of the container directly beneath the platen opening 29 so that envelopes C moved by the conveyor B in a direction indicated by the arrow 37 will drop into the container D through the platen opening 29 and container opening 58 as shown, for example, in FIG. 8.

A guard flange 75 is mounted on the underside of the platen 12 surrounding the platen opening 29 and extending downward to a location close to the top of the container D to inhibit attempts to gain access to the contents of the container when locked to the unit and in open position to receive envelopes being deposited in the container D.

Figure 8:
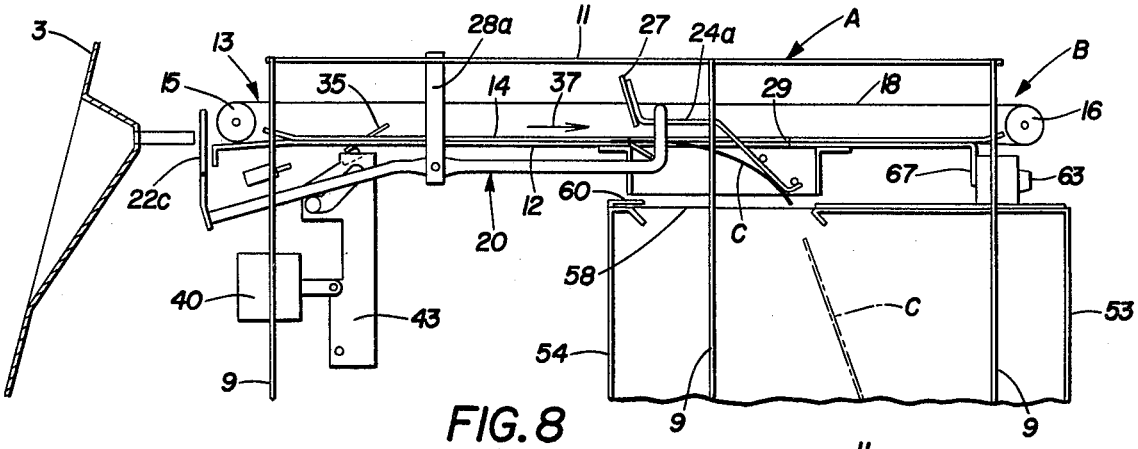
FIG. 8 is a view similar to FIG. 7 showing the conveyor barrier member shifted from open to closed position to permit an envelope to drop into the container component.

The location of the horizontal portions of the fingers 24a and 24b and of the rear gate barrier plates 27 above the platen 12, as described, when the unit and the barrier member 20 have been actuated to the normal closed position, as shown in FIG. 8, permits an envelope C being moved by the conveyor B to pass beneath the horizontal portions of the fingers 24a and 24b and beneath the barrier plates 27, as the envelope C reaches the plate opening 29. Then, the angular portions of the fingers 24a and 24b direct the envelope downward into the container D as shown in FIG. 8. As a further means of directing envelopes C in the proper manner to be stacked in the lower portion of the container, the container may be provided with a V-shaped baffle member 76 (FIG. 10).

The microswitch 36 and its actuator finger 35, which projects through the path of travel of an envelope C being conveyed by the conveyor B, has a special function. As shown, actuator 35 is located close to the zone of the barrier pivot 28. The microswitch 36 preferably is a time-delay switch which controls movement of the conveyor B and controls positioning of the barrier member 20. When the leading edge of an envelope C moved by the conveyor B engages the actuator finger 35, the time-delay switch 36 is actuated to stop conveyor movement momentarily, after a predetermined period of time such that the envelope is moved to a central location between and clear of the barrier entry plate 22 and gate plates 27.

At the same time, the solenoid 40 is de-energized, permitting the spring 49 to move the depository actuator cam 43 to the normal position shown in FIG. 5. Such actuator cam movement moves the barrier member 20 from the open position of FIGS. 6 and 7 back to the closed position of FIGS. 5 and 8. Communication between the tubular entry channel 38 and the conveyor B thus is blocked by the entry barrier plate portion 22c.

During the time when conveyor movement is stopped and the barrier member shifted, a usual or known receipt issuing mechanism (not shown) may be actuated to stamp the envelope through a platen opening in the conveyor and issue a receipt at the receipt slot 8.

At the end of the predetermined time delay period, and after the barrier member 20 has been moved to the closed position, the conveyor B is again energized to move the envelope C being deposited, further along the conveyor to drop it into the container D.

Figure 7:
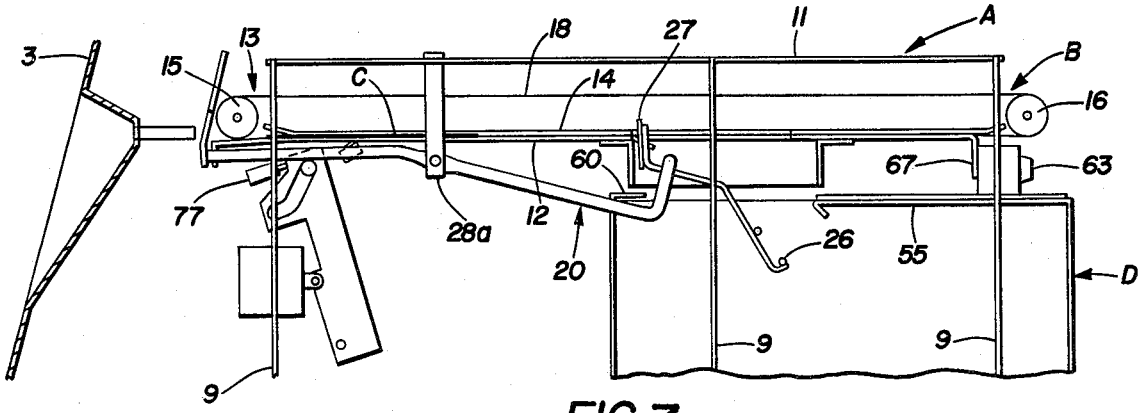
FIG. 7 is a view similar to FIGS. 5 and 6 showing an envelope moved to a central position along the conveyor.

Another microswitch 77 having an actuator flange 78, is mounted on the frame A in a position to be actuated by a shoulder 79 on the depository actuator cam 43 when said actuator cam 43 has moved the barrier member 20 fully to the open position shown in FIGS. 6 and 7. At this time, the conveyor B is energized and draws an inserted deposit envelope into the unit as shown in FIG. 6. The microswitch 77 has a further function of signaling a "full" condition of the container D when the container is too full of envelopes previously deposited therein to accept another envelope as described below.

OPERATION

The concepts of the invention which characterize the new construction and operation involve a locked container D having a slidable lid for an opening in one wall of the container which is key locked in a closed position at a bank where unloading of a container filled with deposit envelopes may take place. There are two similar keys for any particular container and all containers used to service any particular remote unit, which may be used to lock or unlock the container lid lock. One key is located at the bank unloading room and held secure at that location. The other key is mounted in a captive manner in an automatic banking machine unit serving as a depository at a remote location. Such remote unit key is trapped in such a way that it can be positioned in the lock of a locked container only when the container is at a required predetermined location in the banking unit.

The installation of a container D in the banking unit involves sequential steps described below. The locked container D is inserted within the unit until the lock housing 61 engages the stop flange 67 on the platen 12. At this time notched flange 71 (FIG. 11) enters lock housing 61 through slot 61a (FIG. 4c). Further movement of the container at this time under the described conditions thus is stopped.

Figure 4B:
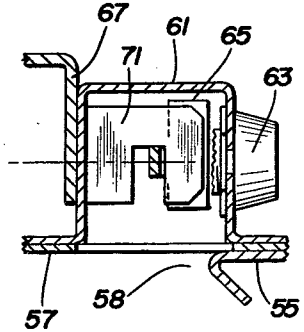
FIGS. 4*a* and 4*b* are fragmentary views on line 4—4, FIG. 4, showing locked and latched positions of the container lock.
Figure 4A:
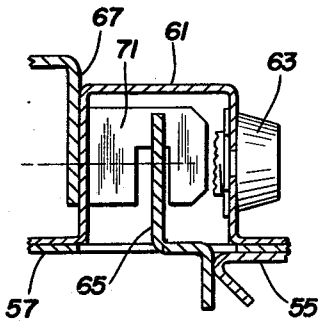

The trapped key 68 held captive at the remote unit then is moved to a position to be inserted in the keyhole 64 of the lock 63 and then the lock is unlocked to release the lid 57 from a locked condition, and simultaneously to engage the lock bolt 65 with the notched flange 71 on the stop flange 67 thereby locking the lid 57 to the unit in latched condition (FIGS. 4a and 4b).

Now the container may be pushed from the position of FIG. 13 to the open position of FIGS. 5 and 14, thus presenting the container top opening 58 in open position beneath the opening 29 in the conveyor platen.

The container now is in position to accept deposits. There is no access into the container when it is in such open position beneath the conveyor.

To remove the container D, the sequence just described is reversed. The lid 57 must first be closed by moving the container from the position of FIGS. 5 and 14 back to the position of FIG. 13. At this time, before the key 68 can be removed it must actuate the lock 63 to release the lock bolt 65 from the notched flange 71 and to engage the lock bolt in lid locked position.

Then the container D can be removed from the unit. Such removal normally occurs when the container D is filled with deposit envelopes and then the container is transported back to the bank unloading room by an accountable messenger who has no direct access to the deposit containing envelopes, per se. The locked container acts as a sealed tamper-indicating container. Any disturbance of the container contents will be evident and is chargeable to the transport messenger.

Typical operation of the depositing cycle for processing deposit envelopes carried out in the use of the new depository unit 1 incorporating the concepts of the invention is illustrated diagrammatically in FIGS. 5 to 9. If the depository 1 happens to be part of a remote cash dispensing banking unit such as illustrated in U.S. Pat. No. 4,154,437, then the use of the equipment generally may have been initiated by a customer using whatever means is provided to energize the unit 1. This may include entry of a plastic customer identification card and other identifying data followed by pressing one of the keyboard keys to energize the depository unit 1.

However, if the depository 1 constitutes a remote deposit station or banking unit by itself, as shown, it can be energized directly merely by pressing one of the keys of the keyboard 5 to energize the unit actuating circuitry and to supply power for the conveyor drive. Such a button may, if desired, be protected by a lock and key not shown; or may be part of a key switch which is unlocked by a key in the authorized possession of a customer.

In any event, the steps that should be taken by the depositor-customer may be set forth in instructions displayed on the instruction panel 4.

A supply of empty deposit envelopes, not shown, may be provided for the unit 1. Regardless of the manner in which the unit 1 is energized, when energized the solenoid 40 is energized, moving the depository actuator cam 43 from the position of FIG. 5 to that of FIG. 6 and the conveyor B is energized. Movement of the actuator 43 shifts the barrier member 20 from the closed position of FIG. 5 to the open position of FIG. 6 and an envelope C may be inserted by the customer through the tubular entry channel 38 and the entry barrier plate notch 22b to the entry end of the conveyor B by center friction ring 15a on roll 15.

Conveyor operation moves the envelope C along the conveyor generally to the position shown in FIG. 7 when the envelope C actuates the finger 35 of the time-delay microswitch 36 momentarily to stop the conveyor after the predetermined time period has elapsed, when the envelope moves completely within the conveyor zone between the barrier entry plate 22 and the rear gate barrier plates 27. During such time delay, the solenoid 40 is deenergized, the barrier member 20 moves back to the closed position as shown in FIG. 8, the conveyor is again energized, and the envelope C is discharged into the container D.

After a further predetermined time has elapsed, the conveyor is de-energized and the unit is ready to accept another deposit upon again being activated by a customer.

Such procedure may be carried out repeatedly until the container D becomes filled with deposit envelopes. As the container fills up, the cross probe sensor member 26 on subsequent actuations from the position of FIG. 5 to the position of FIG. 6 presses deposit envelopes C down into the container.

Figure 9:
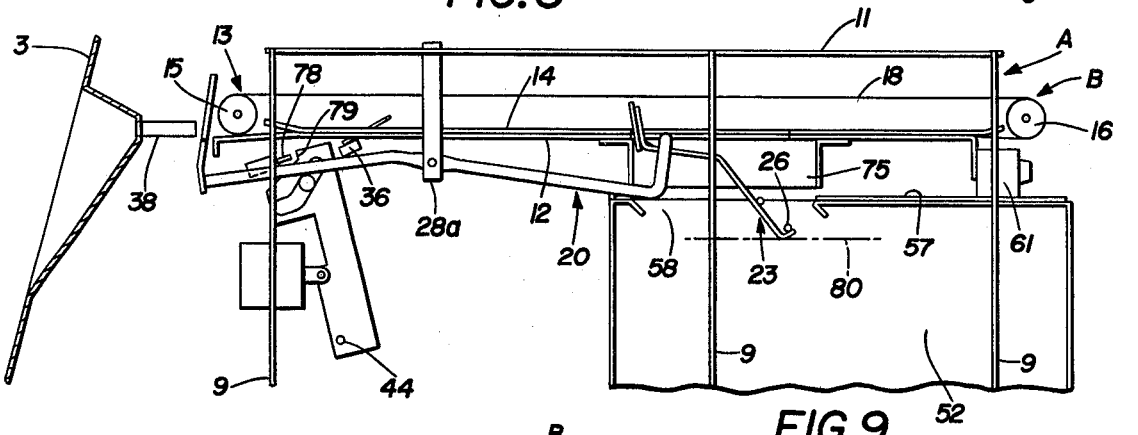
FIG. 9 is a view similar to FIGS. 5 and 6 illustrating conveyor probe movement stopped by a full container and holding its related barrier member in closed position.

When the condition exists, as shown in FIG. 9, where the cross probe sensor member can no longer be moved downward below the fill line indicated at 80, movement of the actuator cam 43 is stopped and its shoulder 79 fails to engage actuator 78 of fill-sensor microswitch 77. When this condition occurs, the failure to actuate switch 77 stops conveyor movement, de-energizes solenoid 40 permitting the barrier member 20 to return to closed position locked by the cam slot portion 45, a message may be displayed at the instruction panel 4 to a customer that the equipment is out of order, and a signal may be given in the usual manner at the central bank through communication circuitry that the unit 1 has a filled container D.

Accordingly, the foregoing new features of the present invention provide new remote depository equipment and mode of operation for supplying remote unattended depository banking services, which equipment will accept deposit envelopes and enable their removal from the remote banking unit and delivery to a central bank under sealed tamper-indicating conditions and at minimum cost by accountable messengers who have no direct access to the deposit-containing envelopes, per se. This is one aspect of the new concepts of the invention.

Another aspect of the invention relates to the concept of a remote depository unit having a lockable deposit receiver into which deposit envelopes are delivered by a conveyor which probes the receiver to sense whether the receiver is filled to capacity, or can accept the deposit of additional envelopes, before any such additional envelopes can be entered into the conveyor.

Still another aspect of the invention relates to the concept of an envelope receiving depository having a belt type conveyor in which one flight of an endless belt is pressed against a platen having a discharge opening through which conveyed deposit envelopes are discharged into an opening in a container which opening may be closed and locked during removal of the container from the conveyor, and in which the conveyor has entry and exit barriers one of which is closed when the other is open and vice versa.

Finally, the new equipment, components, interrelationships and various combinations of components are simplified in construction and mode of operation and achieve the stated objectives, eliminate difficulties present in the operation and use of prior devices, and solve problems and obtain the new results described.

In the foregoing description, certain terms have been used for brevity, clearness and understanding, but no unnecessary limitations are to be implied therefrom beyond the requirements of the prior art because such terms are used for descriptive purposes and are intended to be broadly construed.

Moreover, the description and illustration of the invention is by way of example and the scope of the invention is not limited to the exact details shown or described.

Having now described the features, discoveries and principles of the invention, the manner in which the equipment is constructed and operated, and the advantageous, new and useful results obtained; the new and useful structures, devices, elements, arrangements, parts, combinations, systems, equipment, operations and relationships are set forth in the appended claims.

We claim:

1. Remote automatic banking depository equipment including a housing having a deposit envelope entry slot; belt conveyor means having entry and exit ends; the conveyor means entry end being located adjacent to but spaced from said entry slot; said conveyor means including a flat plate platen, a pressure plate, endless belt means looped around a pair of spaced belt conveyor rolls, and one flight of the belt means extending between and being movable along the platen from one conveyor roll to the other between said platen and pressure plates; said conveyor rolls being located respectively at the conveyor means entry and exit ends, and drive means for at least one of said conveyor rolls; a discharge opening formed in the platen adjacent the belt means; a barrier member pivotally mounted intermediate its ends on the conveyor means having an entry barrier plate and gate barrier plates, respectively, at its ends; said barrier member being movable between normally closed and open positions, the entry barrier plate being located in the space between the conveyor means entry end and said entry slot when the barrier member is in closed position, and said gate barrier plates being located above the platen and above said platen discharge opening when the barrier member is in normally closed position; a container having a deposit-receiving-opening, a lid for the deposit-receiving-opening movable relative to the container between open and closed positions and lock means for locking the lid in closed position; and said container with the lid in open position being located with its deposit-receiving-opening immediately beneath said platen discharge opening.

2. The remote depository equipment as defined in claim 1 in which said container is removably connected with said platen; and in which the container and lid are relatively movable between open and closed positions when the container is connected with the platen.

3. The remote depository equipment as defined in claim 2 in which said container is latch-connected with said platen; in which said lid is locked by said lock means in closed position prior to removably connecting said container with said platen; and in which the latch connecting the container with the platen unlocks the lock means to permit relative movement of said container and lid to open position to locate said deposit-receiving-opening immediately beneath said platen discharge opening.

4. The remote depository equipment as defined in claim 1 in which said container is a tamper-indicating container having said lid normally locked in closed position by said lock means; in which said container is removably latch-connected to said platen; and in which said lock means unlocks said lid upon latch connecting said container to said platen.

5. The remote depository equipment as defined in claim 1 in which said discharge opening is formed in the platen beneath the belt means intermediate the conveyor entry and exit ends.

6. Remote automatic banking depository equipment including a housing having a deposit envelope entry slot; belt conveyor means having entry and exit ends; the conveyor means entry end being located adjacent to but spaced from said entry slot; said conveyor means including a flat plate platen, a pressure plate, endless belt means looped around a pair of spaced belt conveyor rolls, and one flight of the belt means extending between and being movable along the platen from one conveyor roll to the other between said platen and pressure plates; said conveyor rolls being located respectively at the conveyor means entry and exit ends, and drive means for at least one of said conveyor rolls; a discharge opening formed in the platen adjacent the belt means; a barrier member pivotally mounted intermediate its ends on the conveyor means having an entry barrier plate and gate barrier plates, respectively, at its ends; said barrier member being movable between normally closed and open positions, the entry barrier plate being located in the space between the conveyor means entry end and said entry slot when the barrier member is in closed position, and said gate barrier plates being located above the platen and above said platen discharge opening when the barrier member is in normally closed position; a container removably located below and connected to the platen adjacent to and below the conveyor exit end; said container having a deposit-receiving-opening and a lid for and relatively movable with respect to said deposit-receiving-opening, and lock means for locking the lid in position closing said deposit-receiving-opening; and said container upon being connected to the platen being movable with respect to the lid to a position unclosing and locating said deposit-receiving-opening immediately beneath said platen discharge opening.

7. Remote automatic banking depository equipment including a housing having a deposit envelope entry slot; belt conveyor means having entry and exit ends; the conveyor means entry end being located adjacent to but spaced from said entry slot; said conveyor means including a flat plate platen, a pressure plate, endless belt means looped around a pair of spaced belt conveyor rolls, and one flight of the belt means extending between and being movable along the platen from one conveyor roll to the other between said platen and pressure plates; said conveyor rolls being located respectively at the conveyor means entry and exit ends, and drive means for at least one of said conveyor rolls; a discharge opening formed in the platen adjacent the belt means; a barrier member pivotally mounted intermediate its ends on the conveyor means having an entry barrier plate and gate barrier plates, respectively, at its ends; said barrier member being movable between normally closed and open positions, the entry barrier plate being located in the space between the conveyor means entry end and said entry slot when the barrier member is in closed position, and said gate barrier plates being located above the platen and above said platen discharge opening when the barrier member is in normally closed position; means forming a deposit-envelope-receiver communicating with said discharge opening; closure means for said receiver; lock means for said closure means; the barrier member gate barrier plate end having a probe sensor member projecting into said receiver through the platen discharge opening when the barrier member is in open position; said barrier member being biased to normally closed position; means for moving said barrier member from closed to open position; and said probe sensor member during attempted opening movement of said barrier member engaging an accumulation of deposited envelopes in said receiver when the receiver is filled to capacity with deposited envelopes to disable further movement of said barrier member to open position and to enable biased return of said barrier member to closed position.

8. The remote depository equipment as defined in claim 1 in which the barrier member is generally rectangularly shaped and surrounds the entry end and side portions of the conveyor means; in which said entry barrier plate is formed with a notch; in which said entry barrier plate notch is aligned with the entry slot and the conveyor means entry end to provide communication therebetween when the barrier member is moved to open position; in which said gate barrier plates are located to block movement of an envelope conveyed by the conveyor means beyond said gate barrier plates when the barrier member is moved to open position; in which the barrier member gate barrier plate end is provided with a probe sensor member; in which said probe sensor member extends through the platen discharge opening and the container deposit-receiving-opening and into the container when the barrier member is moved to open position; and in which means are provided for moving the barrier member between closed and open positions.

9. The remote depository equipment as defined in claim 8 in which the barrier member is biased to normally closed position; in which the probe sensor member during attempted opening movement of said barrier member engages an accumulation of deposited envelopes in said container when the container is filled to capacity with deposited envelopes to disable further movement of said barrier member to open position and to enable biased return of said barrier member to closed position.

10. The remote depository equipment as defined in claim 8 in which the barrier member moving means includes an actuator cam member pivotally mounted on the conveyor means provided with a cam slot, a cam follower roller on the barrier member engaged in said cam slot, solenoid means connected with the actuator cam member for moving said actuator cam member and said barrier member through cam-slot-cam-follower engagement between barrier normally closed and open positions, the actuator cam member being biased normally to hold the barrier member in closed position, and the solenoid means when energized moving the actuator cam member and barrier member to open position.

11. The remote depository equipment as defined in claim 10 in which the belt conveyor means includes two endless belts looped around said belt conveyor rolls, in which the two belts are spaced laterally, in which the conveyor platen and pressure plates are formed with matched slots intermediate the ends of the platen and between the spaced belts, in which envelope switch means are mounted on the conveyor means having an actuator finger normally extending through said matched slots and across the path of travel of an envelope being moved by the conveyor means, and in which said envelope switch means controls de-energization of the solenoid means when energized; whereby an envelope being conveyed by the conveyor means belts along said path of travel between the platen and pressure plates, when the barrier member has been moved to open position by energizing the solenoid means, engages the envelope switch actuator finger and actuates the envelope switch to disable the solenoid means and thereby enable biased movement of the actuator cam member to move the barrier member to normally closed position.

12. Remote automatic banking depository equipment including a housing having a deposit envelope entry slot; belt conveyor means having entry and exit ends; the conveyor means entry end being located adjacent to but spaced from said entry slot; said conveyor means including a flat plate platen, a pressure plate, endless belt means looped around a pair of spaced belt conveyor rolls, and one flight of the belt means extending between and being movable along the platen from one conveyor roll to the other between said platen and pressure plates; said conveyor rolls being located respectively at the conveyor means entry and exit ends, and drive means for at least one of said conveyor rolls; a discharge opening formed in the platen adjacent the belt means; a barrier member pivotally mounted intermediate its ends on the conveyor means having an entry barrier plate and gate barrier plates, respectively, at its ends; said barrier member being movable between normally closed and open positions, the entry barrier plate being located in the space between the conveyor means entry end and said entry slot when the barrier member is in closed position, and said gate barrier plates being located above the platen and above said platen discharge opening when the barrier member is in normally closed position; a locked, tamper-indicating container removably latch-connected to the platen adjacent to and below the conveyor exit end; said locked container having a normally closed deposit-receiving-opening; and said container upon being latch-connected to the platen being movable to a position unclosing and locating said deposit-receiving-opening immediately beneath said platen discharge opening.

13. The remote depository equipment as defined in claim 1 in which said platen discharge opening is formed with notches; in which the conveyor pressure plate is formed with openings registering with said notches and separated by pressure plate strip portions supporting the belt means; in which said barrier member has fingers on which the gate barrier plates are mounted; and in which said gate plates and fingers move through said notches and registering pressure plate openings when the barrier member moves between normally closed and open positions.

14. The remote depository equipment as defined in claim 1 in which the barrier member gate barrier plate end is provided with a filled-container probe which projects through said deposit-receiving-opening and into the container when the barrier member is moved to open position.

15. The remote depository equipment as defined in claim 14 in which a fill switch is mounted on said conveyor means; in which means is provided for moving said barrier member from closed to open position; in which said barrier member is biased to normally closed position; in which said probe, when engaging deposit envelopes in said container during opening movement of said barrier member, actuates said fill-switch to disable said barrier member moving means to prevent further opening movement of said barrier member and to permit biased movement of said barrier member to closed position.

16. The remote depository equipment as defined in claim 1 in which stop means are mounted on said conveyor means adjacent the conveyor means exit end; in which key means for the container lock means are captive-mounted on a bracket pivotally mounted on said conveyor means exit end; in which a container locked in closed position, when moved beneath said conveyor exit end to engage said lock means with said stop means positions said lock means so that said bracket may be moved to enable said key means to actuate said lock means to unlock the container lid and latch the container to said conveyor means.

17. The remote depository equipment as defined in claim 16 in which the container lock means has a housing and a bolt; in which the stop means is provided with a projecting notched flange; in which said lock housing has a slot; in which the notched flange enters said housing slot when a container lock housing engages said stop means; and in which said lock bolt when the lock means is unlocked by said key means engages with said notched flange to latch the container lock housing to said conveyor means.

18. Remote automatic banking depository equipment including conveyor means having entry and exit ends adapted when enabled to convey toward said exit end deposit envelopes entered into said entry end; lockable deposit receiver means; conveyor discharge opening means communicating with said receiver means; probe sensor means operatively connected with said conveyor means movable into said receiver when said conveyor means is enabled; and said probe sensor means disabling said conveyor means, when engaging an accumulation of deposit envelopes in said receiver means filling said receiver means to capacity, during probe sensor means movement into said receiver means.

19. The remote depository equipment as defined in claim 18, in which said conveyor means is a belt conveyor having a platen, belt means looped around spaced belt rolls at least one of which is driven, and a pressure plate pressing one flight of said belt means against said platen; and in which said discharge opening means is formed in said platen.

20. The remote depository equipment as defined in claims 18 or 19 in which the lockable deposit receiver means is a locked container having a closed deposit-receiving-opening adapted when open to communicate with said conveyor means discharge opening means.

21. The remote depository equipment as defined in claims 18 or 19 in which the lockable deposit receiver means is a sealed, tamper-indicating container having a deposit-receiving-opening closed with a locked lid; in which said container lid is unlocked and latched to said conveyor means; and in which when said lid is so latched the container means may be moved to locate said deposit-receiving-opening beneath said conveyor means discharge opening means.

22. Remote automatic deposit equipment including belt conveyor means having entry and exit ends adapted when enabled to convey toward said exit end deposit envelopes entered into said entry end; said belt conveyor means including a platen, belt means looped around spaced belt rolls at least one of which is driven, and a pressure plate pressing one flight of said belt means against said platen; discharge opening means formed in said platen; a locked container having a closed deposit-receiving-opening; and said deposit-receiving-opening communicating with said platen discharge opening means when the said container is unlocked and its deposit-receiving-opening is opened.

23. The remote depository equipment as defined in claim 22 in which the locked container is a sealed, tamper-indicating container having said deposit-receiving-opening closed by a locked lid; in which said container lid is unlocked and latched to said conveyor means; and in which when said lid is so latched the container means may be moved to locate said deposit-receiving-opening beneath said conveyor means discharge opening means.

* * * * *

UNITED STATES PATENT AND TRADEMARK OFFICE

CERTIFICATE OF CORRECTION

PATENT NO. : 4,312,277

DATED : January 26, 1982

INVENTOR(S) : HARRY T. GRAEF ET AL.

It is certified that error appears in the above-identified patent and that said Letters Patent are hereby corrected as shown below:

Face page of the Patent Item [75] the names of the Inventors should include -Spiro Leontas, Hesperia, California- .

Signed and Sealed this

*Twentieth* Day of *April 1982*

[SEAL]

*Attest:*

GERALD J. MOSSINGHOFF

*Attesting Officer*

*Commissioner of Patents and Trademarks*